US011834224B2

(12) United States Patent
Costello

(10) Patent No.: US 11,834,224 B2
(45) Date of Patent: Dec. 5, 2023

(54) PALLET AND PANEL STORAGE SYSTEM AND RELATED METHODS

(71) Applicant: Mark Harold Costello, Riverbank, CA (US)

(72) Inventor: Mark Harold Costello, Riverbank, CA (US)

( * ) Notice: Subject to any disclaimer, the term of this patent is extended or adjusted under 35 U.S.C. 154(b) by 177 days.

(21) Appl. No.: 17/462,612

(22) Filed: Aug. 31, 2021

(65) Prior Publication Data

US 2023/0062117 A1 Mar. 2, 2023

(51) Int. Cl.
*B65D 19/06* (2006.01)

(52) U.S. Cl.
CPC ..... *B65D 19/06* (2013.01); *B65D 2519/0091* (2013.01); *B65D 2519/00273* (2013.01); *B65D 2519/00422* (2013.01); *B65D 2519/00522* (2013.01); *B65D 2519/00537* (2013.01); *B65D 2519/00601* (2013.01); *B65D 2519/00641* (2013.01); *B65D 2519/00711* (2013.01)

(58) Field of Classification Search
CPC ..... B65D 19/12; B65D 19/06; B65D 2519/0091; B65D 2519/00935; B65D 2519/00975; B65D 2519/00636; B65D 2519/00552; B65D 2519/00412; B65D 2519/00422; B65D 2519/00925
USPC ..... 206/600
See application file for complete search history.

(56) References Cited

U.S. PATENT DOCUMENTS 3,638,790 A 2/1972 Schmid et al.
5,161,709 A * 11/1992 Oestreich, Jr. ..... B65D 25/005 220/4.28
5,423,163 A 6/1995 Wendt
5,597,084 A * 1/1997 Parasin ..... B65D 19/18 220/4.28
6,293,418 B1 9/2001 Ogden et al.
7,963,397 B2 6/2011 Seagle et al.
9,555,921 B1 * 1/2017 Cronin ..... F25D 23/06
9,567,132 B2 * 2/2017 Lundius ..... B65D 19/06
10,315,799 B2 6/2019 Behrens et al.
10,472,152 B2 11/2019 Geier et al.
10,526,099 B2 1/2020 Bison
2006/0226143 A1 * 10/2006 Elstone, Sr. ..... B65D 19/12 220/6

(Continued)

OTHER PUBLICATIONS

Messersi, Messersi Packaging: turnkey packaging line for the glass industry, Solutions/ bottles/sage packaging without lifting, May 11, 2021, https://messersi.com/en/prodotti/soluzioni-bottiglieimballaggio-sicurezza-senza-sollevamento/, Barbara(An) Italy.

*Primary Examiner* — Anthony D Stashick
*Assistant Examiner* — Raven Collins
(74) *Attorney, Agent, or Firm* — SIERRA IP LAW, P.C.; Mark D. Miller

(57) ABSTRACT

Disclosed are systems, apparatus and methods for transporting a palletized stack of bottles or other similar bulk-produced containers using a unique pallet base and a unique set of side panels that may be engaged with the base and with each other in order to protect the stacks of bottles on the pallet base during shipping and transport. Embodiments of the invention dampen vibrations, protect the bottles from exterior contaminants, and allow the bottles to be viewed from the outside. Embodiments of the invention also provide reusable pallet systems that are easy to assemble and disassemble, and ship back for reuse.

25 Claims, 10 Drawing Sheets

(56) References Cited

U.S. PATENT DOCUMENTS

| | | | | |
|---|---|---|---|---|
| 2007/0108090 | A1 | 5/2007 | Whiteside et al. | |
| 2011/0194893 | A1 | 8/2011 | Wiebe | |
| 2014/0197168 | A1* | 7/2014 | Miller | B65D 88/528 220/4.33 |
| 2014/0246353 | A1 | 9/2014 | Campagna et al. | |
| 2017/0037928 | A1* | 2/2017 | Kronkright | F16F 13/005 |
| 2018/0154293 | A1* | 6/2018 | Whittemore | B01D 46/10 |

* cited by examiner

PALLET AND PANEL STORAGE SYSTEM AND RELATED METHODS

FIELD OF THE INVENTION

The present invention generally relates to shipping containers, and more particularly to systems, apparatus and methods for transporting a palletized stack of bottles or other similar containers using a unique pallet base and a unique set of panels that may be engaged with the base in order to protect the stacks of bottles during shipping.

BACKGROUND OF THE INVENTION

Bulk glass bottles and other fragile containers are typically transported from a manufacturer to a bottler in stacks that are loaded on pallets. The glass or other containers are stacked on a pallet in layers with a slip sheet (e.g., a thin cardboard sheet) in between each layer. After the final layer of the stack is completed, a frame or cap is placed on top to provide rigidity, and the unit of stacked containers is then stretch wrapped with plastic or otherwise shrouded. For example, a thermoplastic bag may be arranged around the pallet and heated to compress the bottles together in a single unit. The pallet is then ready for transportation.

Pallets are typically loaded into a semi-trailer or a freighter for transportation via semi-truck, watercraft, or train. To avoid damage to the bottles, the pallet is typically anchored to the interior walls of the semi-trailer with straps positioned around the pallet. Airbags are typically provided between the interior walls, the palletized stack, and other pallets or parcels to help prevent the delicate glass bottles from breaking. Nevertheless, during transport the bottles will still be subjected to vibrations transferred from the road or rough water during transportation, and bottle-to-bottle contact may cause some of the bottles to succumb to surface flaws, cracks, scratches, and fractures. The use of plastic wrap and strapping does not provide uniform rigidity, and in some instances, the bottles may topple over and break, rendering the bulk glass bottles unusable. There is therefore an ongoing need for improved stabilization of palletized stacks of bottles to avoid damage during shipping and transport. It is also desirable to be able to view the bottles in the stack, protect the palletized stack from contaminants, and to provide reusable pallet systems that are easy to assemble and disassemble, and ship back for reuse.

SUMMARY OF THE INVENTION

To address one or more of these and/or other needs or problems, the present inventor devised, among other things, one or more exemplary systems, kits, methods, devices, assemblies, and/or components related to bulk containers, particularly the containment, transport and shipment of bulk glass in warehouses and trailers.

The present invention provides systems, apparatus and methods for transporting a palletized stack of bottles or other similar bulk-produced containers using a unique pallet base and a unique set of side panels that may be engaged with the base and with each other in order to protect the stacks of bottles on the pallet base during shipping and transport. Embodiments of the invention dampen vibrations, protect the bottles from exterior contaminants, and allow the bottles to be viewed from the outside. Embodiments of the invention also provide reusable pallet systems that are easy to assemble and disassemble, and ship back for reuse. These and other features of the present invention are accomplished using a rectangular (usually square) pallet base having patterns of openings on its upper surface. Peripheral openings are provided on the pallet base for engagement with corresponding tabs or protrusions on the bottoms of each of the panels, allowing the panels to be installed on the four sides of the pallet base, around a stack of containers on the pallet base. Additional sets of openings may be provided on the surface of the pallet base for receiving rows of panels for return and reuse. Embodiments of the side panels may be operable to engage with adjacent side panels forming four side walls, and a lid may be installed to form a completed pallet container.

In embodiments of the invention, the interior surfaces of the panels may be provided with dampening material to prevent the transfer of vibrations to the stack of containers therein, providing a relatively static environment during bulk storage or transportation. Embodiments of the pallet containers of the present invention may further provide weather protection, and one or more of the panels may include viewports operable to allow a user to monitor or view the contents of the container. Embodiments of the completed containers of the present invention may include one or more attachment mechanisms to link adjacent completed containers together to form a chain or matrix of containers that are highly stable during transport.

Embodiments of the present invention provide a front and back panel that may be interchangeable each having an exterior surface, an interior surface, and a perimeter comprising top, bottom, right, and left edges. The bottom edge may include one or more protruding male connecting members for engagement with corresponding female connecting openings along an edge of the pallet base. In other embodiments, the bottom edge may include one or more female connecting openings for engagement with corresponding protruding male connecting members along an edge of the pallet base. In other embodiments, the bottom edge may include both male and female connecting members which engage with corresponding female and male connecting members on the pallet base. It is to be appreciated that the male/female connecting members on the bottom edge and pallet base may be provided in alternating, symmetrical, asymmetrical, or other suitable complementary arrangements.

Similarly, in embodiments of the invention, the top edge of the front and back panels may include one or more female connecting openings operable to align with corresponding protrusions on a lid for the container. In other embodiments, the top edge may include one or more protruding male connecting members for engagement with corresponding female connecting openings along an edge of the lid. In other embodiments, the top edge may include both male and female connecting members which engage with corresponding female and male connecting members on the lid. It is to be appreciated that the male/female connecting members on the top edge and lid may be provided in alternating, symmetrical, asymmetrical, or other suitable complementary arrangements.

On the top and bottom edges of embodiments of the front and rear panels, the connecting members and openings may be on a plane of symmetry parallel to the interior and exterior surface of the panel. At the two upper corners of the interior surface of embodiments of the front and back panels, rods may be provided that protrude out orthogonally to the plane of the interior surface. The rods may each maintain symmetry with respect to a horizontal and a vertical axis. The rods be placed near the edges of the interior surface in order to be engageable with corresponding conduits in the left and right side panels, described below.

In embodiments of the invention, left and right side panels are provided that may be interchangeable, each such panel having an exterior surface, an interior surface, and a perimeter comprising top, bottom, right and left edges. The bottom edge may include one or more protruding male connecting members for engagement with corresponding female connecting openings along an edge of the pallet base. In other embodiments, the bottom edge may include one or more female connecting openings for engagement with corresponding protruding male connecting members along an edge of the pallet base. Similarly, the top edge of the side panels may include one or more female connecting openings operable to align with corresponding protrusions on a lid for the container. In other embodiments, the top edge may include one or more protruding male connecting members for engagement with corresponding female connecting openings along an edge of the pallet base. It is to be appreciated that the male/female connecting members provided on the top edge and lid, and those provided on the bottom edge and pallet base, may be provided in alternating, symmetrical, asymmetrical, or other suitable complementary arrangements.

On the top and bottom edges of embodiments of the side panels, the connecting members and openings may be on a plane of symmetry parallel to the interior and exterior surface of the panel. The right and left edges may be provided with upper conduits operable to receive the rods of the front and back panels. The conduits may have an axis orthogonal to the interior surface of the left or right side panel. The conduits may have an axis on the plane of symmetry. In addition, the right and left edges of the side panels may be provided with one or more female openings operable to receive one or more connecting male members of the front or back panels.

In some embodiments, the rods may be made of metal and may have a magnetic charge that attracts them to corresponding metal conduits in the left and right side panels. In these and other embodiments, the surface of the panel adjacent to each rod may have one or more magnetically charged members that are attracted to one or more corresponding metal members on the surface of the left or right side panel adjacent to the conduits. It is to be appreciated that in alternative embodiments, the magnetic and metal parts may be reversed. For example and without limitation, the rods may be made of metal and the conduits may be magnetically charged, and/or the members adjacent to the rods may be made of metal and the members adjacent to the conduits may be magnetically charged. The magnetic attraction between the rods and conduits (and/or between the members adjacent to them) allows for adjacent front/rear and left/right panels to be engaged with each other in an upright (vertical) position, allowing for more secure strapping to then be used to firmly secure the panels together.

In some embodiments, the male connecting members may be substantially circular in cross-section, and the female receptacle of the base pallet may have a conduit operable to receive the male connecting member. In some embodiments, the male connecting members may protrude from the bottom surface of the panel and may have a substantially round geometry, and may have a generally oval cross-section. In some embodiments, the female connecting members on the pallet base may have a geometry complementary to the male connecting member and may be operable to align the panel with the pallet base. In some embodiments, the male connecting member may protrude out from the base at least one half of an inch and may extend out no more than three inches. In some embodiments, the female connecting member may have a depth larger than the protrusion of the male connecting member. In some embodiments, the female receptacles of the side panels may have a substantially round geometry and provide a generally oval cross-section and have a depth of one inch, and the male members of the front and rear panels may have a depth complementary to the female receptacles. In some embodiments, the male connecting members may have geometric characteristics that have a tapering geometry where the protrusion from the bottom surface has the largest cross-section, and the apex of the protrusion has the smallest cross-section.

Some embodiments of the present invention provide panels with a plurality of viewing windows. Exemplary viewing windows may have a substantially circular, rectangular, or elliptical geometry and may provide an aperture for a transporter to monitor the contents of the container. Some embodiments of the invention provide a tension system that may align with a layer of bottles in a palletized stack of bottles. The tension systems provide dampening characteristics that absorb vibrations and prevent damage to the layers of bottles. In some embodiments, members of the tensioning system may be provided between viewing windows, and may come into contact with the bottles at the label height and may be integrated into the interior surface of the panel. In some embodiments, the tension system may be provided in the form of ribbing, and may have a sinusoidal geometry that caresses the bottles. In some embodiments, the ribbing in the system may be manufactured from durable foam such as polyethylene foam, high-density rigid foam, and EVA foam, as an example.

In some embodiments, the tension system may be constructed from a plurality of tension bands molded to the inside of the panel manufactured from a deformable plastic or nylon material with a geometry operable to provide a dampening resistance such as a leaf spring. In some embodiments, the leaf springs may be removably attached to the interior surface of the panel with a fastener (e.g., rivet, screw, hook and loop). In other embodiments, the tension system may include a plurality of connected air bladders positioned on the interior surface of the panel in line with the label height of the bottles in the stack, and the air bladders may be in a deflated state while the container's perimeter is assembled. Once the perimeter panels (back, front, right and left) are connected, the air bladders may be inflated and may have an inflated geometry that is substantially elongated and may conform to the space between the stack of bottles and the panel. In different embodiments, any or all of the aforementioned tensioning systems may be used independently or in combination with each other.

In embodiments of the invention, each panel (front, rear, left, right) is provided with at least one engagement device for securing the panel to an adjacent panel. These engagement devices may be provided in the form of one or more hooks, clamps, clips, hinges, or other similar devices on one panel that engage with one or more openings or receptacles on an adjacent panel. In some embodiments of the invention, the engagement devices (e.g., hooks or latches) may be provided on the outer surface of the panel along a left or right side, and the openings or receptacles on the adjacent panel may be provided on an adjacent side. For example, and without limitation, one or more hooks may be provided on the right sides of all panels, and receptacles for receiving the hooks may be provided on the left sides of all panels; in these embodiments, the right side of each panel is engaged with the left side of another panel, forming a rectangular enclosure. In some embodiments, the hooks may be provided on flexible straps that are mounted to the first panel. In these embodiments, the flexible strap may be stretched to allow the hook to engage a receptacle on an adjacent panel, which then pulls the adjacent panel firmly against the first panel, forming a corner. It is to be appreciated that other securing structures may be used to engage adjacent panels including latches, clamps, clips, or other hinged attachments.

In addition to the engagement devices for securing a panel to an adjacent panel, the sides of each panel may be provided with one or more male or female connecting members for engagement with complementary engagement members on a side of an adjacent panel, for alignment and reinforcement. In some embodiments, these alignment members may be provided on the right and left edges of the side panels may be provided with one or more female openings operable to receive one or more connecting male members of the front or back panels. The male/female alignment members may be provided in alternating, symmetrical, asymmetrical, or other suitable complementary arrangements.

Embodiments of the present invention provide load locking systems and methods (e.g., alignment systems and methods) that may be operable to engage an assembled container with one or more adjacent assembled containers. The load locking embodiments include male protrusions (e.g., male receptacles) and/or female cavities (e.g., female receptacles) positioned on the exterior surfaces of one or more of the front, back, left, and/or right side panels. In some embodiments, the positions of the male and female receptacles may be alternated. In some embodiments, the receptacles may be provided under the bottommost viewing windows on a panel's exterior surface. In some embodiments, the receptacles may (also) be provided on the pallet base. The receptacles enable assembled containers to interlock together, which provides stability and eliminates the need for airbags between each container. In these embodiments, the assembled containers may engage with another container on any exterior side. The protrusions and cavities may have complementary geometries that allow the containers to align uniformly, forming a string or array of containers. In some embodiments, the male protrusions may have a tapering cross-section that allows the protrusion to align with the corresponding female cavity.

The panels and base pallet may be manufactured from any suitable durable material including without limitation rigid plastic, wood (e.g., debarked wood), recycled plastics, and heat-treated materials. The damping members should be made from a flexible and/or slightly deformable material, such as without limitation foam, rubber, silica, silicone, or other similar materials. The viewing windows may be open, or they may be made from a transparent or semi-transparent material such as, without limitation acrylic, polycarbonate, polyethylene terephthalate, amorphous copolyester (PETG), PVC, Polyethylene, or like materials.

In one exemplary embodiment, the invention takes the form of a bulk glass containment system formed from a set of interconnectable weatherproof panels, a pallet base, and a lid that can be configured to define a boxlike containment structure over and around a volume of cargo. In this embodiment, the four panels may include: left-right side panels, front-back side panels, plus a bottom pallet base and a top lid. In this embodiment, each panel may have three half round protuberances located on the bottom of the panel that enter into a matching set of receptacles on the inner edge of the pallet base. The front and rear panels may have metal rods located at the top corners which slide into holes which are located in the top corners of the right and left panels. The rods and holes may be magnetically attracted to each other. The front and back panels may have a protuberance which is half way down from the metal rods on the front and back panels and slides into receptacles in the right and left panels when assembled. Each panel may be provided with multiple hooks along an edge that attach to an edge of the next corresponding panel. The lid may have protuberances that go into receptacles that are located on the top of each panel. The panels may be interconnected via manual latching hooks, to define a square or rectangular perimeter around the volume of cargo. A top lid may overlay the perimeter panels to fully enclose the cargo. In these embodiments, the four stabilizing panels may have a protruding rib that is built into each panel. These ribs may be provided between each row of viewing holes built into the panels and are designed to butt up against the cargo for a tight fit when all panels are assembled around the cargo. The ribs can be molded into the panel or made of a different softer material can be attached after the panel has been made. In these embodiments, the pallet base may have a series of holes from the front panel to the back panel to accommodate used panels that need to be shipped back to the factory for re-use. A load locking system incorporating a series of oval receptacles and protuberances may be integrated into the panels, sometimes at the bottom. This enables the units to interlock, eliminating the need for airbags during shipment. In some embodiments, the receptacles may be located on the bottom front and left and the protuberances may be located on the bottom right and back giving a single unit the ability to lock side to side and front to back.

In some aspects of the invention, the pallet panel storage system for the transportation of a stack of fragile containers may comprise a pallet base having a top surface, a base, and stringers therebetween with a span that may be operable to receive the forks for moving the pallet, where the top surface has a plurality of channels operable to align a side panel. Such pallet panel storage systems may include a front and a back panel having an interior and an exterior surface, a right, a left, a top, and a bottom surface, comprising a metal rod positioned at the upper corners of the panel, where the rod has a neutral axis perpendicular to the planar face of the panel, and at least one male connecting member on the interior surface of the panel adjacent to the right and left surfaces. These embodiments further include a right and a left panel having an interior and an exterior surface, a right, a left, a top, and a bottom surface, comprising a slot having a magnet operable to engage with the metal rod of the front and back panel, where the slot may be positioned in a plane between the interior and exterior surfaces of the right and left panel, and an at least one female receptacle having a geometry complementary to the male connecting member on the interior surface of the panel adjacent to the right and left surface; and a lid having a lip operable to secure to the top of the front, back, right, and left panels forming a container.

In other aspects of the pallet panel storage system of the present invention, the lid may further comprise a frame fixed to an interior surface of the lid where the frame has a plurality of concavities with a geometry complementary to the stack of fragile containers. The interior surface of the front, back, right, and left panels may have a dampening material operable to reduce the vibration of the fragile container. Magnets on a side panel may be fixedly secured to the inmost location of the slots located thereon. The dampening material may include a plurality of ribs providing compression to the stack of fragile containers. The interior ribs may be an air bladder operable to be inflated after the system of panels may be aligned with the pallet base. The front, back, right, and left panels may have a plurality of viewing ports distributed linearly and horizontally on the panel in line with a layer of bottles in said stack of bottles and may be operable to provide a transporter with a visual of the state of said stack of fragile containers. The pallet panel storage system may further comprise a plurality of hooks and a plurality of latches on the exterior surface of the front, back, right, and left panels, where the hooks are operable to secure adjacent panels together on the exterior surface. The hooks or latches may be operable to strap around an edge of a front and side panel to hook or latch into an opening on the exterior surface of an adjacent panel. The bottom surface of the right and left panels and the front and back panels may have a plurality of male protrusions operable to engage with the channel of the pallet base. The exterior surface of the right and left panels and the front and back panels may further comprise an alignment system having alternating male and female channels operable to align a first container system with a second container system.

In other aspects, the present invention relates to a pallet panel container system for the transportation of a palletized stack of glass bottles, the system comprising a pallet base having a substantially rectangular perimeter and a conduit on the side operable to receive the forks of a forklift, and a top surface having a plurality of female channels parallel to the edge and offset from the perimeter of the pallet base, a side panel having an exterior surface, an interior surface, a bottom surface with a plurality of male channels operable to nest into the pallet base's female channels, a top surface with a plurality of female channels positioned between the exterior and interior surface, and a side surface having a female receptacle positioned at the horizontal axis of the side panel and a slot having a neutral axis that may be equidistantly positioned between the top, interior, and exterior surfaces, a front and rear panel having an exterior surface, a bottom surface with a plurality of male channels operable to nest into the female channels of the pallet base, a top surface with a plurality of female channels positioned between the exterior and interior surface, an interior surface having a male receptacle offset from the perimeter and positioned at the horizontal axis of the front panel, and a rod having a neutral axis that may be equidistantly positioned between the top surface, and a side surface, and a top panel having a substantially rectangular perimeter and a plurality of male channels offset from the perimeter on a bottom surface, wherein the male channels have a geometry complementary to the plurality of female channels on the top surface of the side panel and the front and rear panels. The pallet panel system may include a palletized stack of glass bottles that may be centered on the pallet base's top surface, and a perimeter of the container may be formed around the stack of glass bottles and includes a first and second side panel on opposing sides of said glass bottles, and the front and rear panel on opposing ends of the first and second side panels, the bottom male connecting members of each of the panels may be aligned with the female connecting members of the pallet base, the female receptacles and the slot of the side panel are operable to receive the male receptacles and rod of the front and rear panels to align the perimeter with the pallet base perimeter and the container may be sealed with said top panels male connectors nesting into the female connectors of the first, second, front, and back panels.

In other aspects of the present invention, the side panels and the front and rear panels may further comprise a plurality of horizontally distributed viewing holes that penetrate through the exterior surface to the interior surface and may be aligned with the necking of a bottle in the palletized stack. The viewing holes may have a transparent material therein operable to provide a visual for a user to view the palletized stack of glass bottles and prevent debris from entering the container. The plurality of horizontally distributed viewing holes may have a position in line with each row of bottles in the palletized stack. The plurality of horizontally distributed viewing holes may be at least one hole. Where the one hole may be an elongated hole. [connected to below]

In another aspect of the present invention, the system may further comprise a dampening material attached to the interior surface of the side panels and the front and rear panels. The dampening material may come into contact with each bottle in said stack of bottles and may be positioned between the plurality of viewing holes. The dampening material may have a geometry that may be substantially complementary to the geometry of a glass bottle and is positioned at the label height of said layer of bottles. The dampening material attached to the interior surface may be removable and replaceable to conform to bottles having different geometries. The dampening material may be an air bladder operable to be inflated after the container is secured together. On the exterior surface of the front and rear panels and side panels, there may be a latch and hook system operable to link adjacent panels on a panels edge securing the perimeter of the container, wherein the latch is positioned on one side and a hook is positioned symmetrically on another side. The latch and hook system may be a ratcheting mechanism operable to link adjacent panels together around the perimeter's edge. The exterior surface may have at least two latches and a hook system on the surface operable to link adjacent panels. The exterior surface of the front and rear panels, and the side panels may further comprise an alignment system having alternating male protrusion and female cavity with matching geometries. The alignment system of the exterior surface of a first pallet container system's rear panel, may be operable to align with the alignment system of a second container system's front panel. The top surface of the front and rear panels and the side panels may further comprise a plurality of magnetic inserts positioned between the plurality of female channels, and the lid may have a bottom surface having complementary magnetic inserts aligned with the plurality of magnets on the top surface. The alignment system may be operable to interlink a first pallet system container with a second pallet system container forming a chain of pallet container systems coalescing uniformly for transportation.

It is to be appreciated that in alternative embodiments, all four of the panels may be identical. Each such panel may have an exterior surface, an interior surface, and a perimeter comprising top, bottom, right, and left edges. The bottom edge may include one or more protruding male connecting members for engagement with corresponding female connecting openings along an edge of the pallet base, and the top edge may include one or more female connecting openings operable to align with corresponding protrusions on a lid for the container. At one upper corner of the interior surface of each panel, a rod may be provided that protrudes out orthogonally to the plane of the interior surface. At an opposite upper corner, the edge of the panel may be provided with an upper conduit operable to receive the rod of an adjacent panel. The conduits may have an axis orthogonal to the interior surface of the panel. The rods and conduits may be made of complementary metal and magnetically attractive materials, or those materials may be provided adjacent to the rods and conduits. In addition, along the surface of each panel and below the rod, one or more connecting members (e.g., male protrusions or female openings) may be provided which engage with corresponding complementary connecting members (e.g., female openings or male protrusions) which are provided along an opposite edge of each panel. Each panel is provided with at least one engagement device for securing the panel to an adjacent panel, such as a hook, latch, clip or clamp as described previously. Each panel may also be provided with a locking mechanism as described previously to enable an assembled container made from such panels to engage with one or more other assembled containers. Each panel may also be provided with damping devices as described previously to reduce vibration.

To use an embodiment of the present invention, stacks of containers (e.g., glass bottles) are loaded upon a base pallet of the present invention. These are usually separated by slip sheets. Once containers are stacked on the pallet base, four panels are engaged with the base and with each other around the stacks. In some embodiments, this involves engaging the bottoms of left and right side panels with the pallet base, then engaging front and rear panels with the pallet base, and then inserting the rods of the front and rear panels into the conduits of the side panels such that the magnetic attraction holds them together. In other embodiments where all panels are the same, this involves engaging the bottoms of a first panel with the pallet base, then engaging an adjacent panel with the pallet base and with the first panel by inserting the rods of one panel into the conduits of the adjacent panel such that the magnetic attraction holds them together; this is repeated until all four panels are erected. Then, for each of these embodiments, the hooks, latches, clamps or clips on the edges of the panels are engaged with corresponding structures on the adjacent panels to hold them firmly together. In those embodiments having interior air bag dampeners, once the panels are firmly engaged, the air bags are inflated. A lid is then placed on the assembled unit, which is then ready for transport. Multiple assembled units may be engaged with each other to provide stability and prevent slippage during transport. After delivery, the lid may be removed, and the panels disassembled by first disengaging the hooks, latches, clamps or clips on the edges of the panels and then removing the panels. The stacks of bottles may then be removed. The many openings on the pallet base may then be used to receive rows of panels for easy return transport for reuse.

Further aspects and embodiments will be apparent to those having skill in the art from the description and disclosure provided herein.

It is therefore an object of the present invention to provide methods and apparatus for improved shipping containers for palletized stacks of fragile containers such as glass bottles that provide sturdy enclosures for protecting the fragile containers during shipping and transport.

It is also an object of the present invention to provide methods and apparatus for improved shipping containers for palletized stacks of fragile containers such as glass bottles that dampen vibrations of the fragile containers inside the shipping containers during shipping and transport.

It is also an object of the present invention to provide methods and apparatus for improved shipping containers for palletized stacks of fragile containers such as glass bottles that protect the fragile containers from exterior contaminants.

It is also an object of the present invention to provide methods and apparatus for improved shipping containers for palletized stacks of fragile containers such as glass bottles that allow the containers inside to be viewed from the outside.

It is also an object of the present invention to provide methods and apparatus for improved shipping containers for palletized stacks of fragile containers such as glass bottles that are easy to assemble and disassemble, and ship back for reuse.

It is also an object of the present invention to provide methods and apparatus for improved shipping containers for palletized stacks of fragile containers such as glass bottles that may interlock with adjacent shipping containers into rows or arrays to provide stability for the group of interlocked containers during shipping, storage and transportation.

It is also an object of the present invention to provide methods and apparatus for improved shipping containers for palletized stacks of fragile containers such as glass bottles that eliminate the need for wrapping a palletized stack of glass bottles with plastic and eliminate the need for airbag dampeners.

It is also an object of the present invention to provide methods and apparatus for improved shipping containers for palletized stacks of containers that may be used with any cylindrical container made for the use of holding any liquid made of any material which is produced by standard bulk container production.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1:
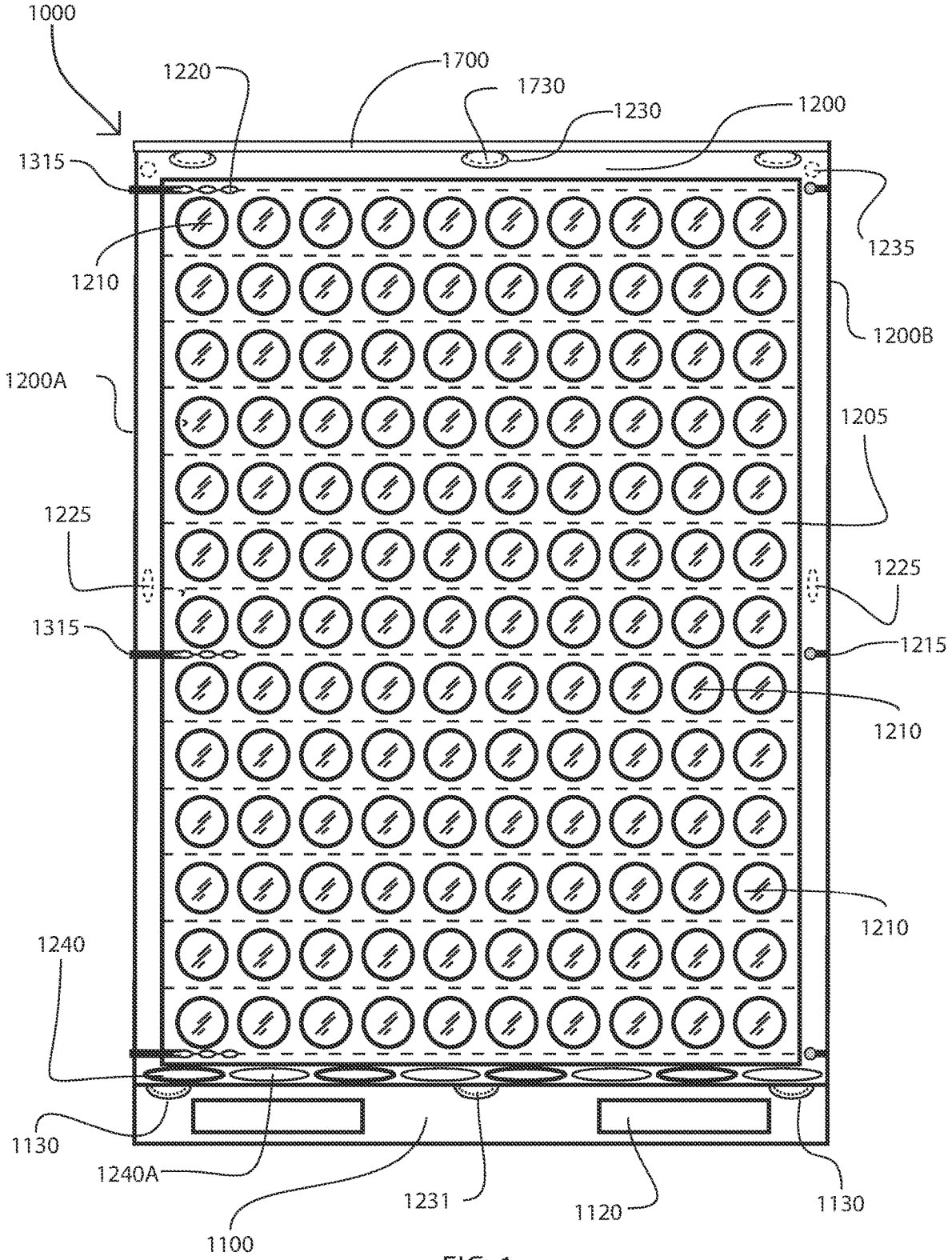
FIG. 1 provides an exemplary illustration of a front or rear exterior view of an assembled pallet panel system, according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

It is to be appreciated that although the illustrated embodiments depict many instances of male and corresponding female connecting members, in other embodiments some or all of these may be swapped, i.e., one or more male connecting members may be swapped for female connecting members, and vice versa. It is also to be appreciated that although the male and female connecting members are shown as oval holes and protrusions in the illustrations, in other embodiments, some or all of these complementary members may be of any suitable cooperating shape including round, square, rectangular, hexagonal, octagonal or any other multi-sided shape.

The present invention concerns a pallet panel system, apparatus and related methods that may be used to transport fragile bottles, fragile parcels, or transportation of fragile packages. FIGS. 1-14 provide views of an exemplary pallet panel system 1000 comprising a pallet base, a plurality of panels and a lid. The exemplary embodiment illustrated in the drawings includes identical front and back panels 1200, identical right and left panels 1300, a top panel or lid 1700, and a pallet base 1100. Openings 1120 may be provided in base 1100 to receive the arms of a forklift.

Referring to the front view of FIG. 1, it is seen that the illustrated assembled pallet panel system 1000 includes an exemplary front panel 1200 according to an embodiment of the present invention. The front panel 1200 may include a plurality of view windows 1210 distributed longitudinally and laterally. It is to be appreciated that although many rows of many windows 1210 are illustrated in FIG. 1, in other embodiments fewer, larger, or smaller windows may be provided; or they may be provided in different patterns; or no windows may be provided at all.

Figure 2:
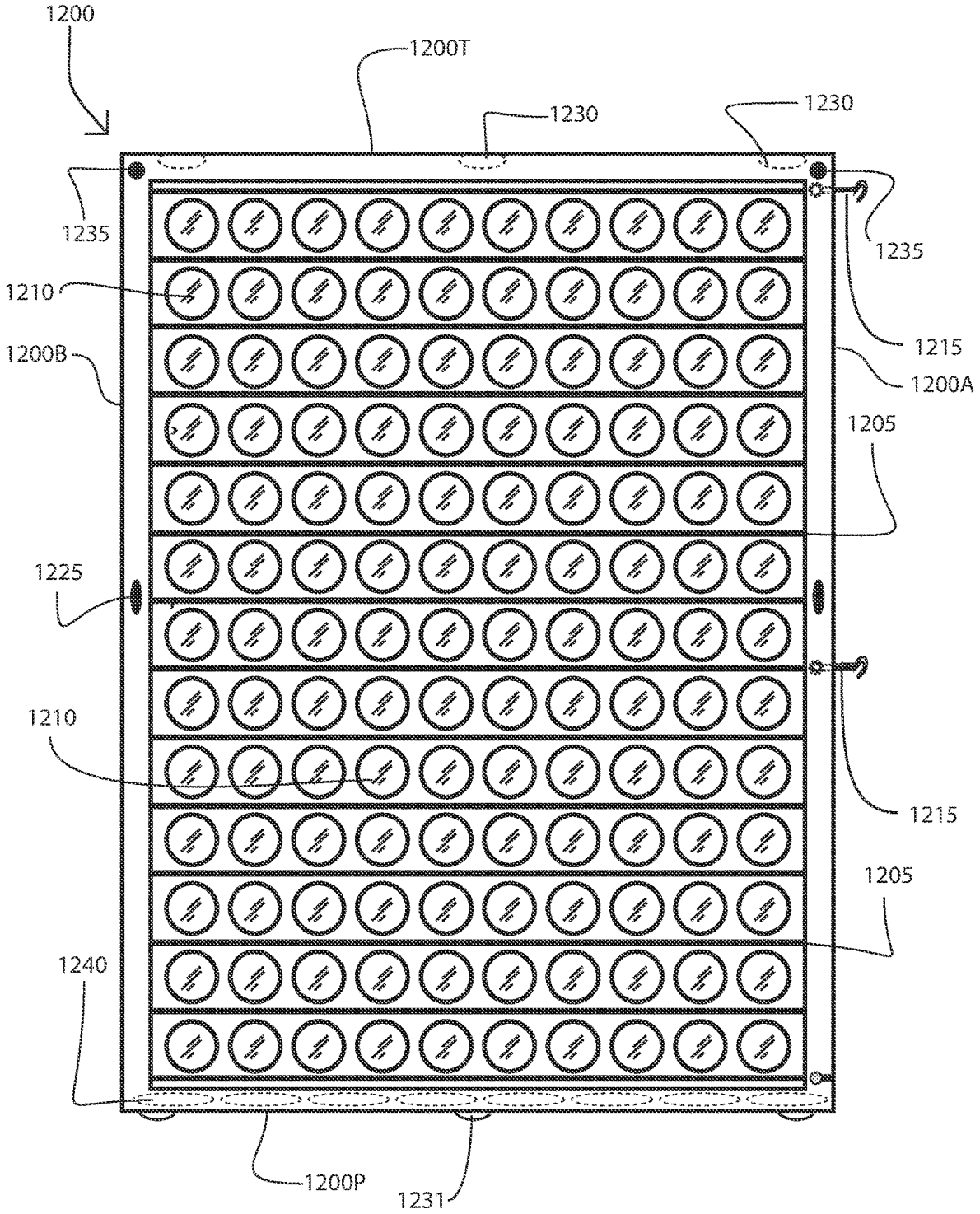
FIG. 2 provides an exemplary illustration of an interior surface of a front or rear panel of a pallet panel system, according to an embodiment of the present invention.

FIG. 2 provides a view of an interior surface of an exemplary front or rear panel 1200, which includes a panel top edge surface 1200T, a bottom pallet interfacing edge surface 1200P, a side edge surface 1200A, and an opposite side edge surface 1200B. On the top edge surface 1200T, there may be a plurality of female connecting channels 1230 operable to receive a connector 1730 of the top panel 1700 (shown in FIG. 10). It is to be appreciated that although the illustrated embodiment depicts female connecting channels 1230 that engage with male connectors 1730, in other embodiments these may be swapped (i.e., channels 1230 may be male, and connectors 1730 may be female). It is also to be appreciated that although the male and female connecting members are illustrated as oval holes and protrusions, that they may be of any suitable cooperating shape including round, square, rectangular, hexagonal, octagonal or any other multi-sided shape.

In the interior view of the embodiment of FIG. 2, a plurality of male connecting members 1231 may be provided on pallet edge surface 1200P operable to nest into complementary female channels 1130 of the pallet base 1100. (It is to be appreciated that in alternative embodiments, some or all of these male/female members may be swapped.) Stability ribs 1205 may be positioned at various locations along the interior surface of panel 1200 in order to touch and provide dampening to the bottles inside. In this illustrated embodiment they are located between the viewing windows 1210. In the embodiment illustrated in FIG. 2, connecting rods 1235 are positioned at top corners of panel 1200 (e.g., at the junction of 1200A and 1200T, or junction 1200B and 1200T). Rods 1235 are positioned perpendicular to the interior surface and may be operable to nest into openings 1335 of the right and left side panels 1300B, 1300A. This engagement is illustrated in FIG. 3.

Figure 3:
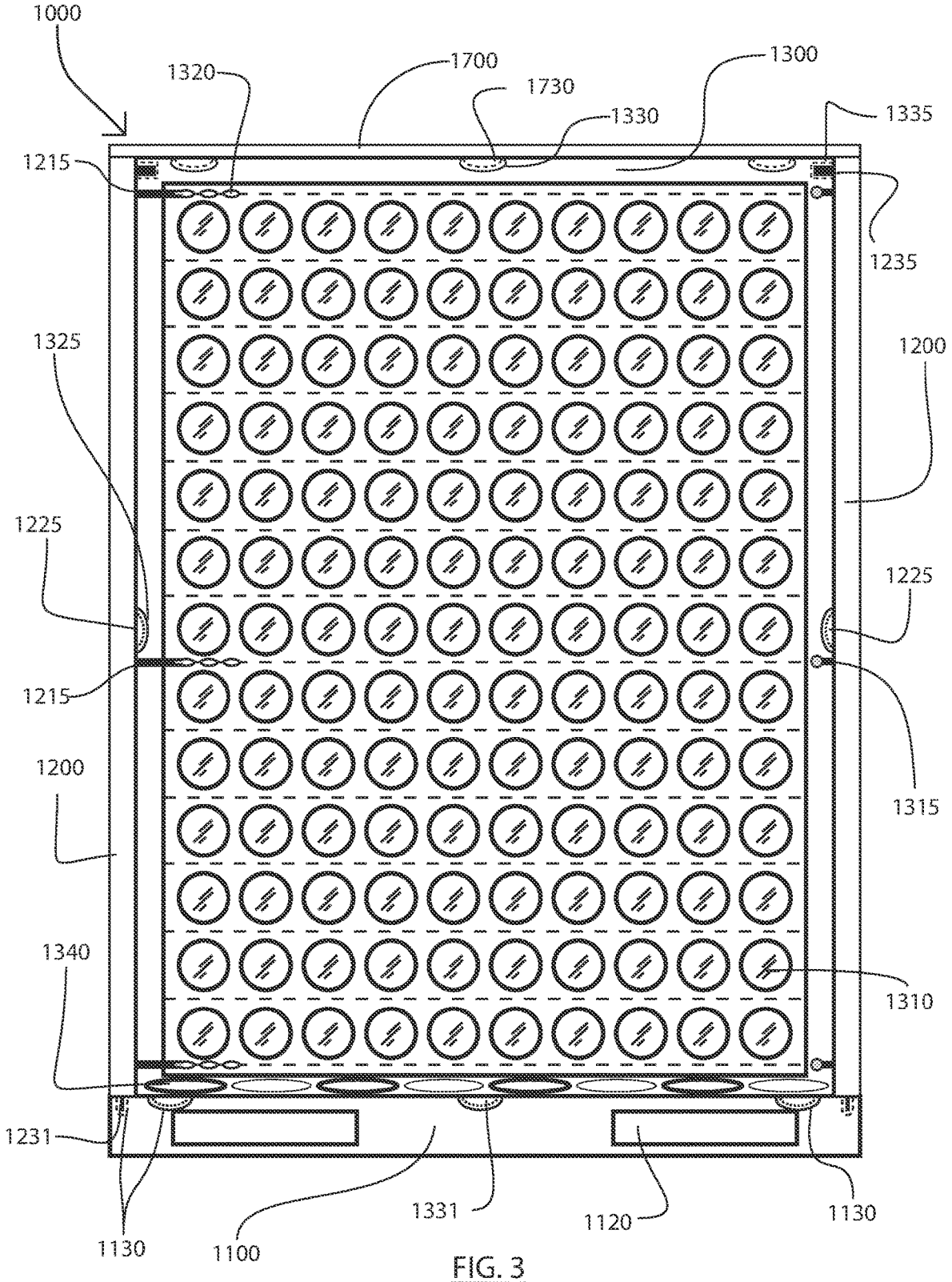
FIG. 3 provides an exemplary illustration of an exterior side view of an assembled pallet panel system, according to an embodiment of the present invention.
Figure 4:
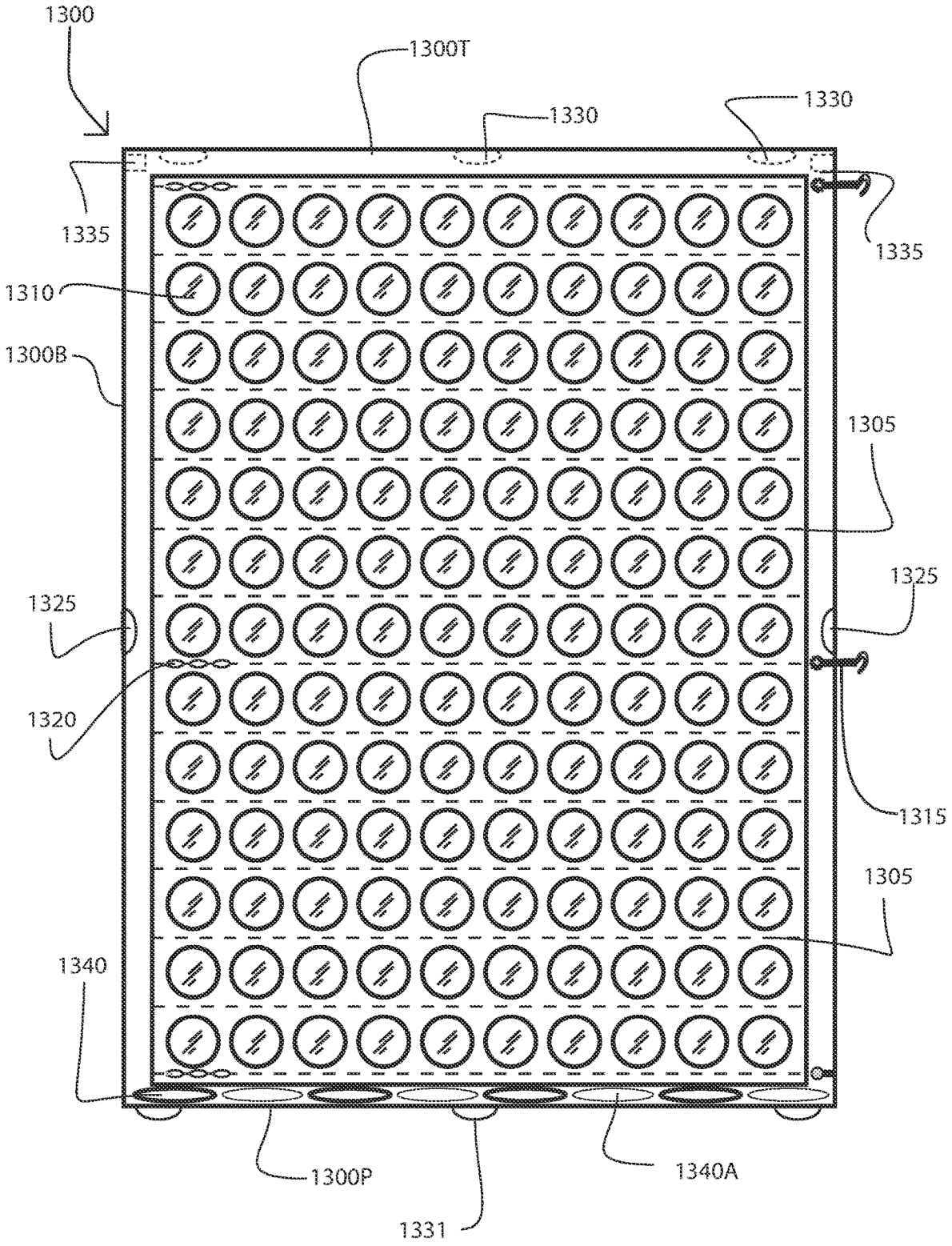
FIG. 4 provides an exemplary illustration of an exterior side view of a side panel of a pallet panel system, according to an embodiment of the present invention.

FIGS. 3 and 4 provide side views of the pallet panel system 1000, more specifically a front view (exterior surface) of a side panel 1300 (e.g., a right side or left side) according to an embodiment of the present invention. The side panel 1300 may be sandwiched between the front and back panels 1200, top panel 1700, and the pallet base 1100 as shown in FIG. 3. The side panels 1300 may have a pallet interfacing surface 1300P, a panel top surface 1300T, and two side surfaces 1300A, 1300B. On the front surface of panel 1300, there may be a plurality viewing windows 1310 distributed laterally, allowing a user to view the parcel's contents inside the pallet system 1000. It is to be appreciated that although many rows of many windows 1310 are illustrated in FIGS. 3 and 4, in other embodiments fewer, larger, or smaller windows may be provided; or they may be provided in different patterns; or no windows may be provided at all. The side panels 1300 may be independently aligned with the pallet base 1100 with the connectors 1331 nesting into a channel on the pallet base 1100.

Figure 5:
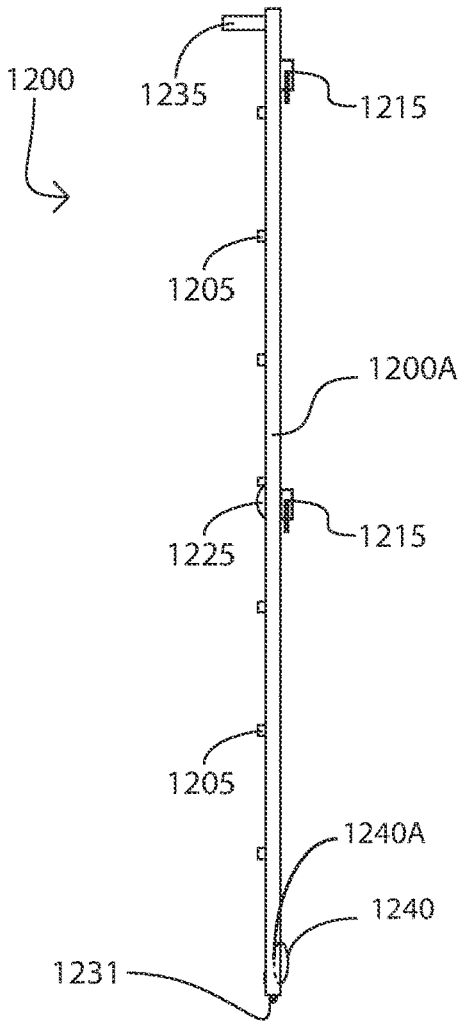
FIG. 5 provides an edge view of a front or rear panel, according to an embodiment of the present invention.
Figure 6:
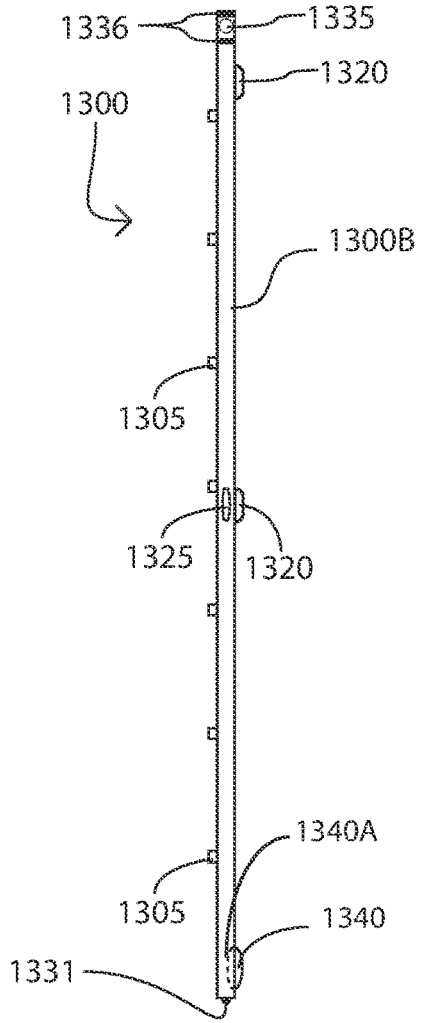
FIG. 6 provides an edge view of a side panel of a pallet panel system, according to an embodiment of the present invention.

FIG. 5 shows a profile view of the side surface 1200A of the illustrated embodiments of the front/rear panel 1200, and FIG. 6 shows a profile view of the side surface 1300B of the illustrated side panels 1300. The two illustrated panels 1200, 1300 are operable to align with the pallet base 1100 such that the male connecting members 1231, 1331 nest into the complementary pallet base channels 1130 (see FIG. 11). The connecting member (rod) 1235 slides into the connecting channel (slot) 1335 on the side surface 1300B of the side panels 1300. In some embodiments (not shown), rod 1235 may be magnetic, and slot 1335 may be made of metal for attraction; in other embodiments (not shown), rod 1235 may be of metal, and slot 1335 may be attractively magnetic. In the illustrated embodiment of FIGS. 5 and 6, magnetic members 1336 are provided which engage metal members around the connecting member 1235 to magnetically secure the panels together.

The exemplary front panel illustrated in FIG. 5 may include a connecting member 1225 that may be operable to engage a receiving channel 1325 on the side 1300B of side panel 1300. The connecting member 1225 may be positioned on the horizontal axis on the front panel's interior surface and may bulge out of the surface, and on the side panel's side surface 1300B and the horizontal axis, there may be a receiving channel 1325 that may be operable to receive the connecting member 1225 and align the panels before. (It is to be appreciated that in alternative embodiments, male/female members 1225, 1325 may be swapped.) The receiving channel 1325 and connecting members 1225 may have complementary geometries suited to align each panel with the adjacent panel. The geometries may be substantially curved, triangular, or rectangular but may be substantially smooth to promote alignment without excessive force applied to a panel 1300, 1200 for alignment.

Referring to FIG. 5, it is seen that a plurality of stability ribs 1205 may be provided on an interior surface of panel 1200, operable to interface with fragile containers 1600 (e.g., glass bottles, etc.). Referring to FIG. 6, it is seen that a plurality of stability ribs 1305 may be provided on an interior surface of panel 1300, operable to interface with fragile containers 1600 (e.g., glass bottles, etc.). The ribs may be provided between the viewing windows 1310 as shown in FIG. 4 with the dotted lines 1305. The ribs 1305 may be positioned such that the ribbing is aligned with each bottle's labeling in a stack of bottles 1600. Ribs 1205 and 1305 may have a dampening characteristic and a geometry equal to the geometry of the object or glass bottle.

The panels in the illustrated embodiment are designed to be attached to adjacent panels. For example, latch 1215 of a front panel 1200 may hook into a receiver 1320 of a side panel 1300, and latch 1315 of a side panel 1300 may hook into a receiver 1220 of a rear panel 1200 (see FIGS. 9 and 12). When joined, in some embodiments the panels may form a substantially square perimeter, in other embodiments the perimeter may be substantially rectangular. In other embodiments, the hooks 1315 may be replaced with a hook and pawl mechanism (e.g., ratch), and the system may be secured together by increasing the tension of the straps and the panels around the four corners of the exterior surface.

Figure 9:
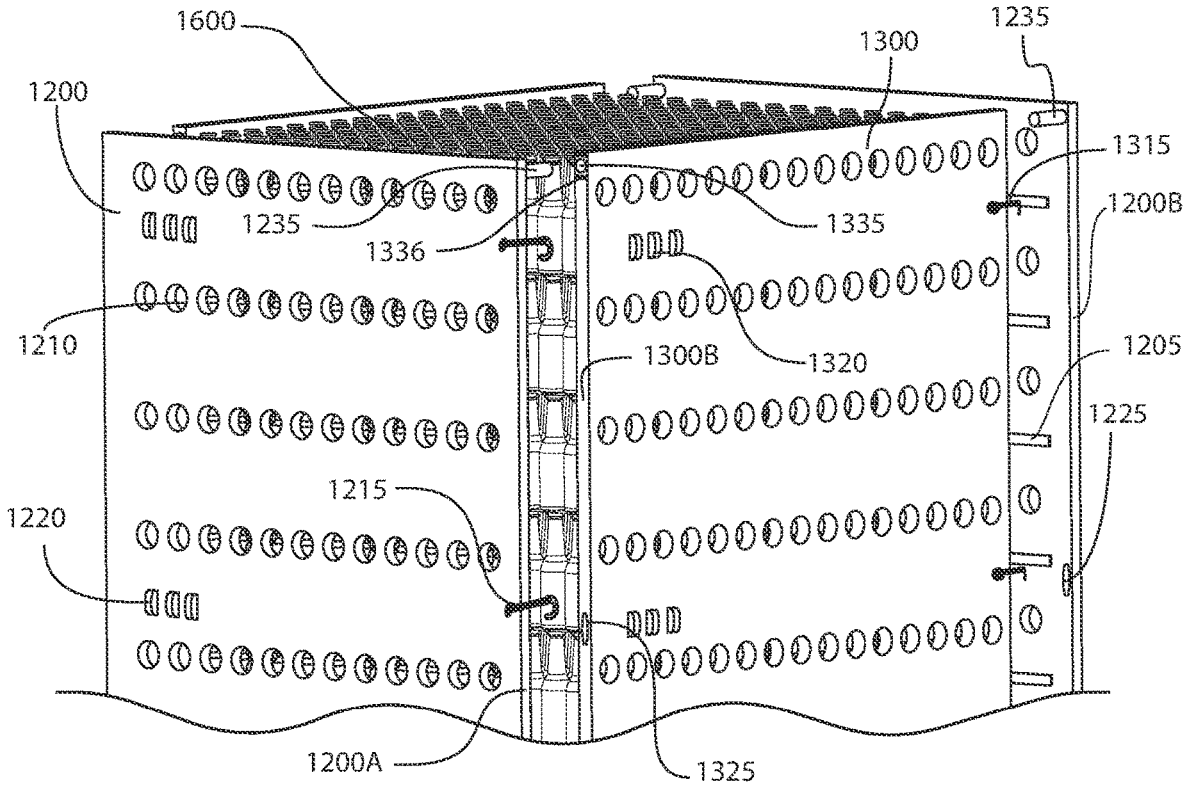
FIG. 9 provides a cropped perspective and exploded view of a pallet panel system according to an embodiment of the present invention.

FIG. 9 provides an exploded view of exemplary embodiments of front panels 1200 and side panels 1300. The illustrated side panels 1300 may first secure the male connecting members 1331 to the complementary channel 1130 of the pallet base 1100. The side panels 1300 may be positioned such that the front and rear panels 1200 may be slid into position with the connecting members 1231 nesting into the complementary channel 1130 of the pallet base 1100, and may enable the connecting rods 1235 to nest into the connecting rod location 1335 on the side surface 1300B. The magnetic interaction between 1235 and 1335 (or members 1336) may hold the front and rear panels 1200 in place against side panels 1300 while a user secures the perimeter of the panels. The panels may be fastened together with the hooks 1215 that are engaged with receivers 1320.

Figure 11:
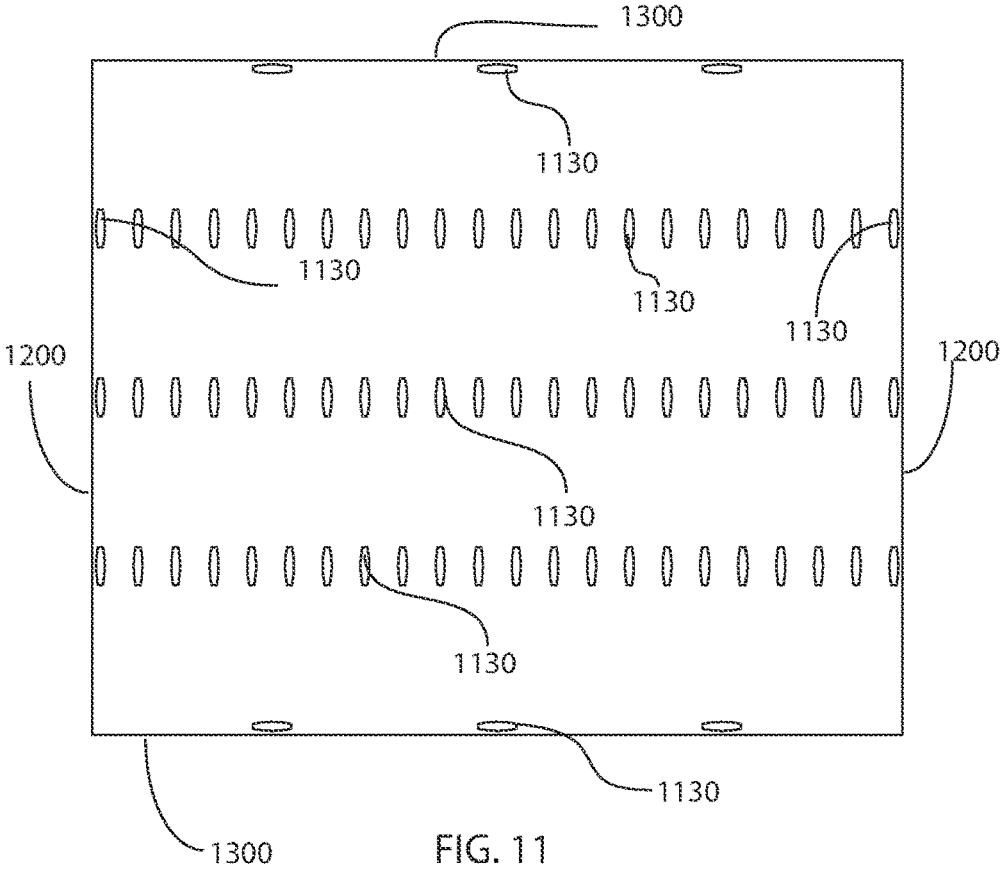
FIG. 11 provides a top view of a base pallet of the pallet panel system, according to an embodiment of the present invention.

In some embodiments, the connecting rod location 1335 may be a slot operable to accommodate a rotation of the front panel 1200 about the complementary channel 1130. The pallet base 1100 may be operable to provide a base for receiving a stack of bottles 1600 and may have thereon the top surface with a plurality of receiving channels 1130 operable to receive the connecting members 1231, 1331 of the exterior panels 1200, 1300. An exemplary top-down view of the pallet base 1100 is shown in FIG. 11.

Figure 10:
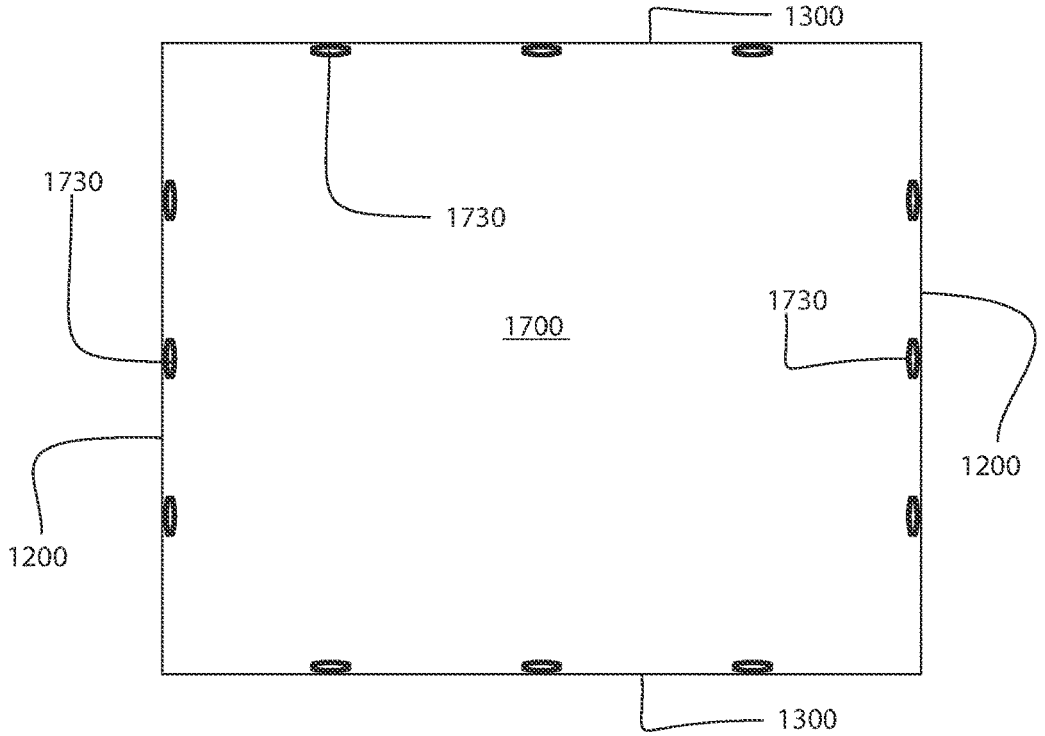
FIG. 10 provides a bottom view of a lid of a pallet panel system, according to an embodiment of the present invention.

Once the panels are attached to each other, the container may be sealed with a lid 1700, an exemplary embodiment of which is shown in FIG. 10. Male connecting members 1730 on the lid are operable to engage with the top surface channels 1330 and 1230 of the perimeter panels 1200 and 1300. This may seal the panel system 1000. In some embodiments, the interior surface of the container lid 1700 may also include a magnetic strip (not shown) aligned with the perimeter edge of the lid. In such embodiments, the top surface 1200T, 1300T may have a plurality of magnets therebetween the channels 1330, 1230, the channels may guide the lid into position, and the magnets may secure the lid in place and seal the container. In other embodiments, male protrusions may be provided on upper surfaces 1200T and 1300T for engagement with openings 1730. (It is to be appreciated that in alternative embodiments, some or all of these male/female members may be swapped.)

Figure 7:
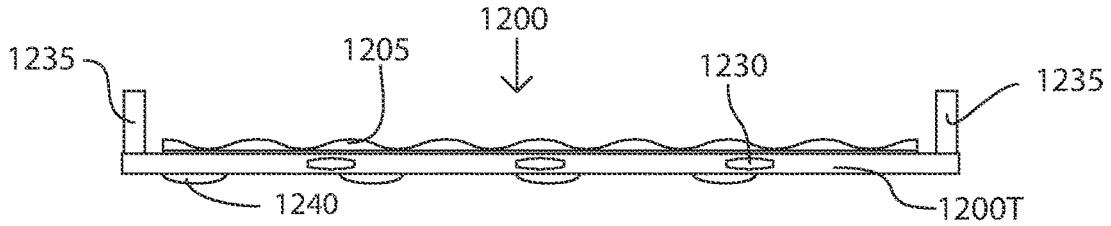
FIG. 7 provides a top view of a front or rear panel of a pallet panel system, according to an embodiment of the present invention.
Figure 8:
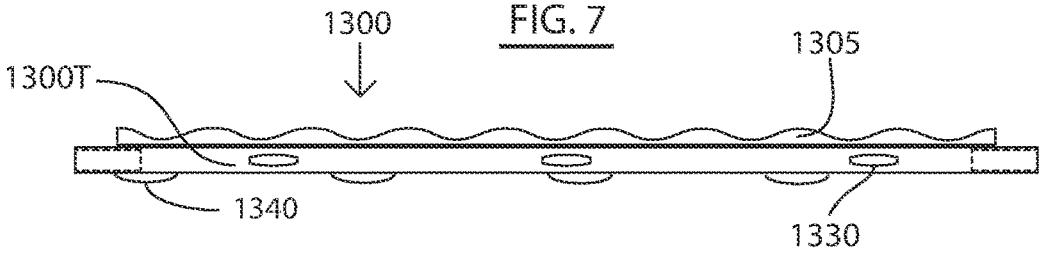
FIG. 8 provides a top view of a side panel of a pallet panel system, according to an embodiment of the present invention.

FIG. 7 provides an exemplary top view of front or rear panel 1200 including top surface 1200T, and FIG. 8 provides an exemplary top view of side panels 1300T. Embodiments of the invention may provide on the interior of each panel a dampening structure (e.g., tensioning system, ribbing) 1205, 1305 with a geometry that may be complementary to the exterior surface of a glass bottle and may contact the bottle (not shown). The ribbing 1205, 1305 may be operable to apply tension to the bottles and dampen the vibrations produced from transportation. The tension system (e.g., ribbing) 1205, 1305 may be integrated into the interior surface of the perimeter panels and may be manufactured from durable foam such as polyethylene foam, high-density rigid foam, and EVA foam as examples. In other embodiments, the tension system may be a plurality of tension bands molded into the inside of the panel manufactured from a plastic or nylon material that has a geometry operable to provide a dampening resistance such as a leaf spring (not shown). In such embodiments, the leaf springs would replace the ribbing 1205, 1305 locations of the present invention and may be removably attached to the interior surface of the panel with a fastener. In yet other embodiments, the tension system may include a plurality of connected air bladders positioned in place of the ribbing 1205, 1305 on the panel's interior surface in line with the bottle's label height in the stack (not shown). The air bladders may be deflated prior to assembly of the container 1000. In such embodiments, once the perimeter panels are connected, the air bladders may be inflated and may have an inflated geometry that is substantially elongated or may conform to the space between the stack and the panel. A combination of the aforementioned tensioning systems may be used in combination. The male channels 1240 and 1340 are shown to have a substantially convex outer protrusion that may be operable to nest into the female channels 1240A, 1340A and are staggered to lead on one edge.

The panel frame 1200 may be manufactured of wood (e.g., debarked wood), recycled plastics, and heat-treated materials. The stability ribs 1205 may be constructed of foam material, rubber material, silica silicone, or maybe of a cardboard composite construction, materials typically used in the transportation of fragile containers. The viewing windows 1210 may be manufactured of a transparent or semi-transparent material such as, but not limiting, acrylic, polycarbonate, polyethylene terephthalate, amorphous copolyester (PETG), PVC, Polyethylene, or like materials, having mechanical properties allowing for deflection and absorption of vibrations, and not likely to fracture.

Figure 11A:
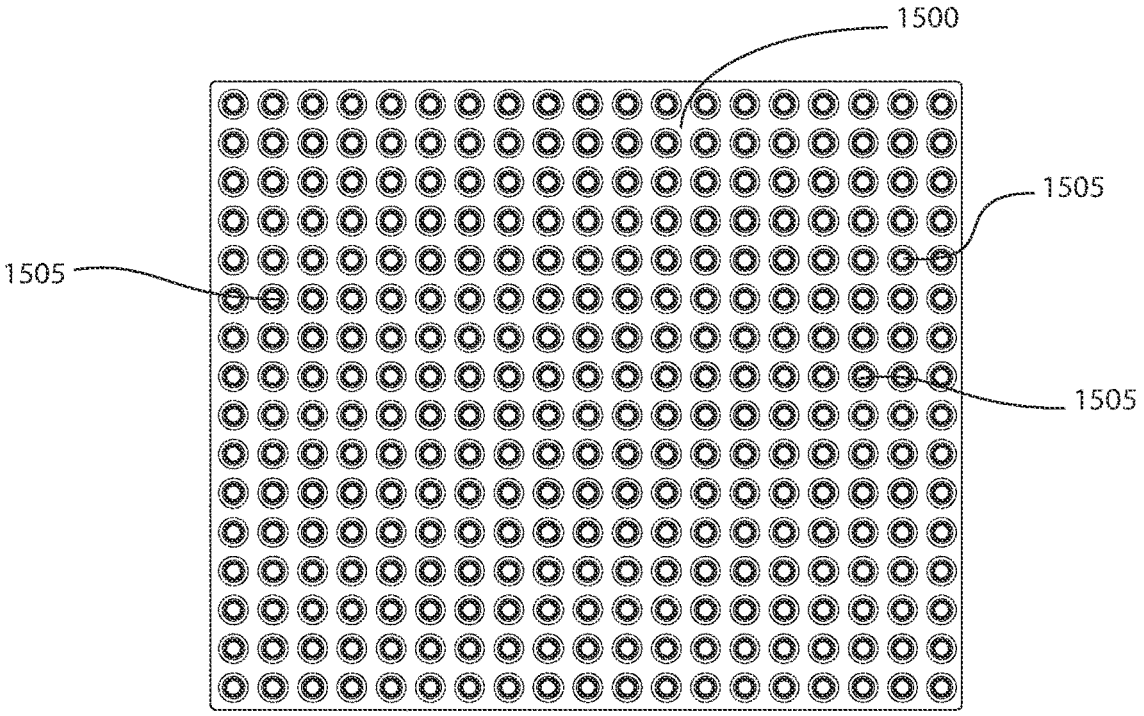
FIG. 11A provides a top view of a bottle frame of a pallet panel system, according to an embodiment of the present invention.

Embodiments of the panel system of the present invention may be assembled by one or more people. The pallet base 1100 may receive a palletized stack of containers (e.g. glass bottles) 1600, where a layer of bottles is uniformly positioned in an array or matrix, and a slip sheet (e.g., cardboard sheet, plastic sheet) is placed on top of the layer of bottles. Another layer of bottles is placed uniformly on top of the sheet and a sheet is placed on top. The process is repeated for subsequent layers of bottles until a palletized stack 1600 is formed. A stack may be formed on top of the pallet base 1100 or may be rolled on top of the pallet base 1100. Once the stack of bottles 1600 is centered on the pallet 1100, an optional frame 1500 (a bottle lid) may be positioned on top of the bottles. An exemplary top-down view of the frame 1500 is provided in FIG. 11A. The frame 1500 may have a plurality of holes 1505 matching the position of each of the bottles in the topmost layer of the stack 1600 and may have a perimeter that is less than the interior perimeter of the panels 1200, 1300 when assembled. The frame holes 1505 may have a diameter equal to the diameter at a location at the neck of the bottle.

Figure 12:
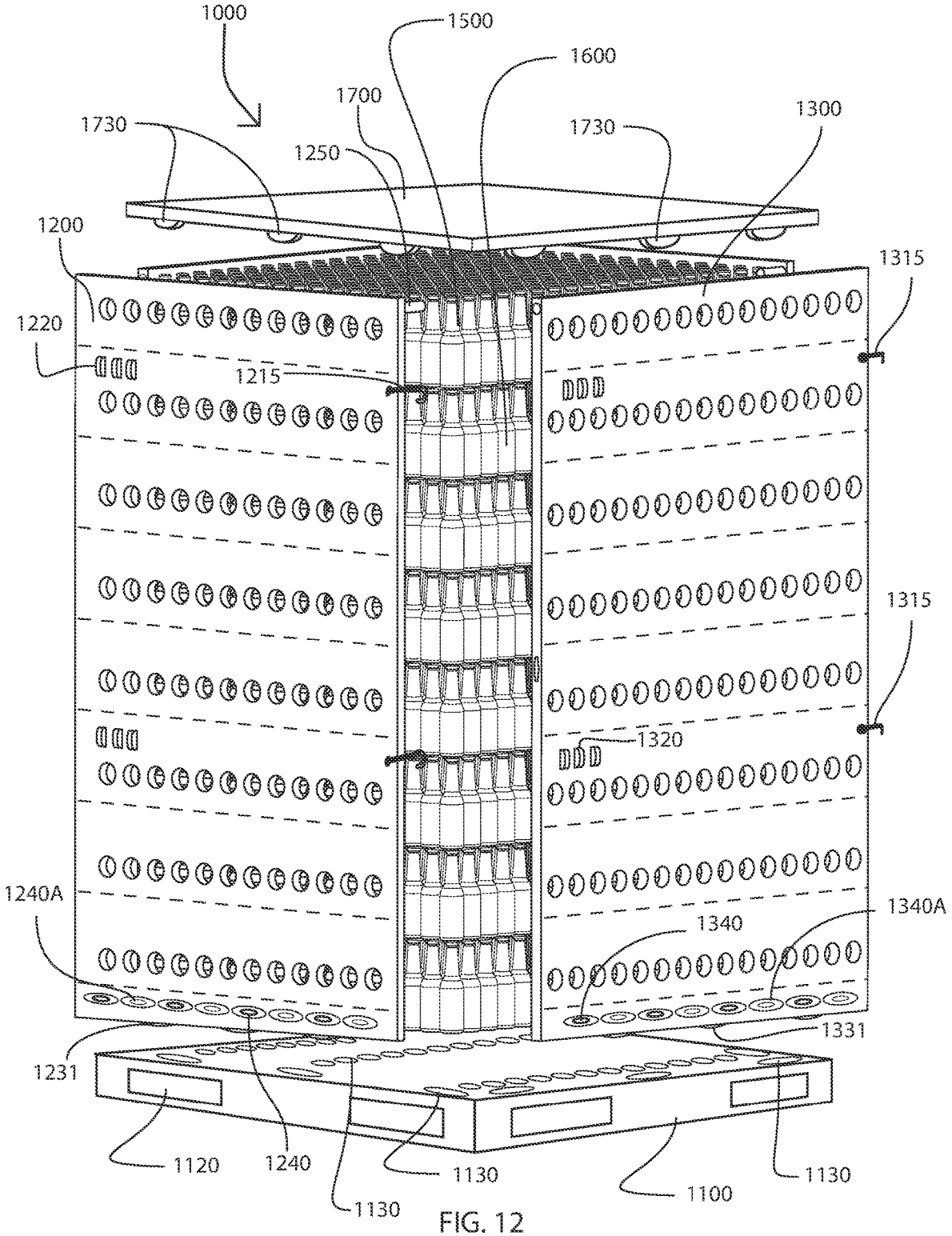
FIG. 12 provides an exploded view of a pallet panel system, according to an embodiment of the present invention.
Figure 13:
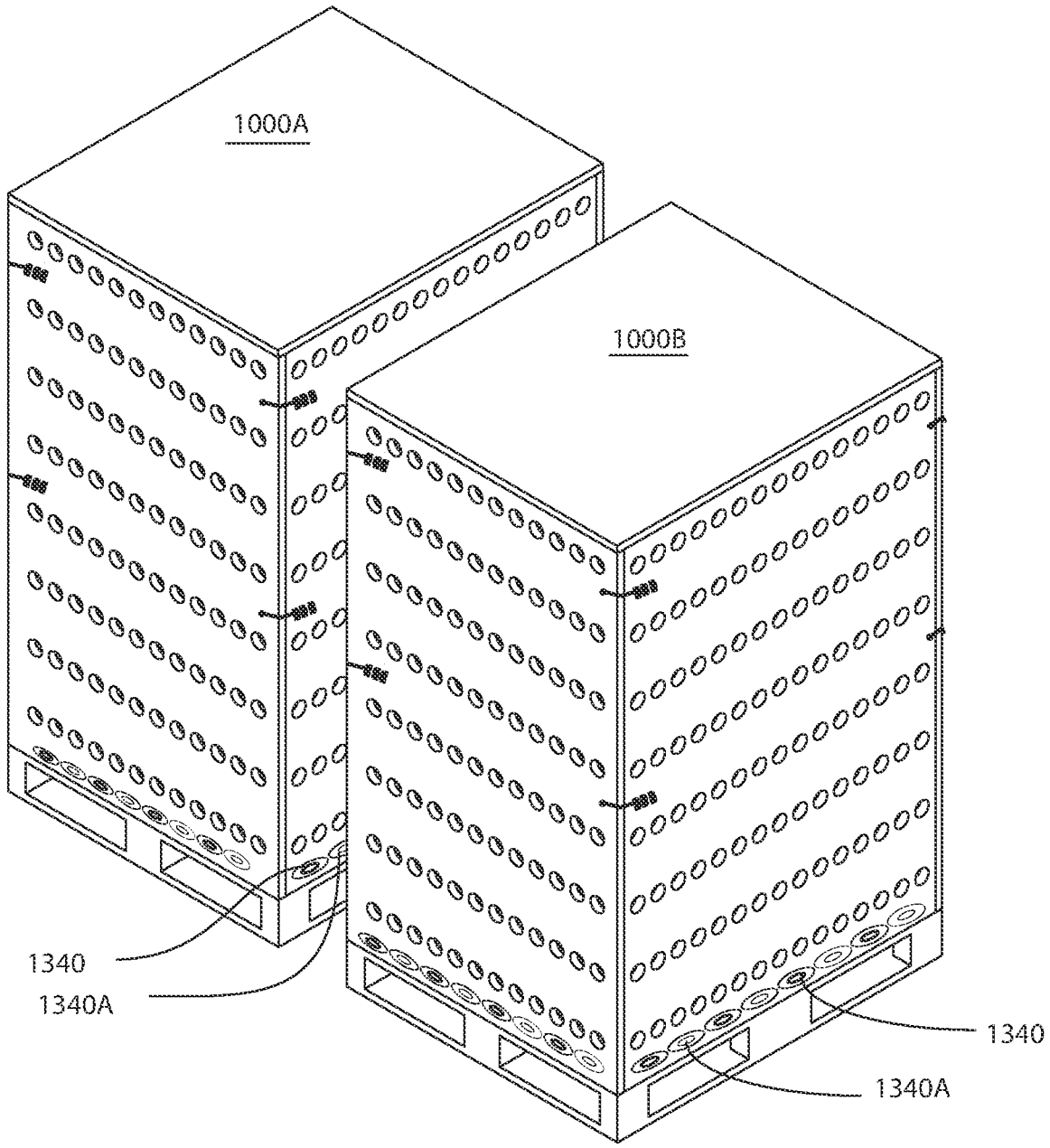
FIG. 13 provides a perspective view of two assembled pallet panel systems, according to an embodiment of the present invention.
Figure 14A:
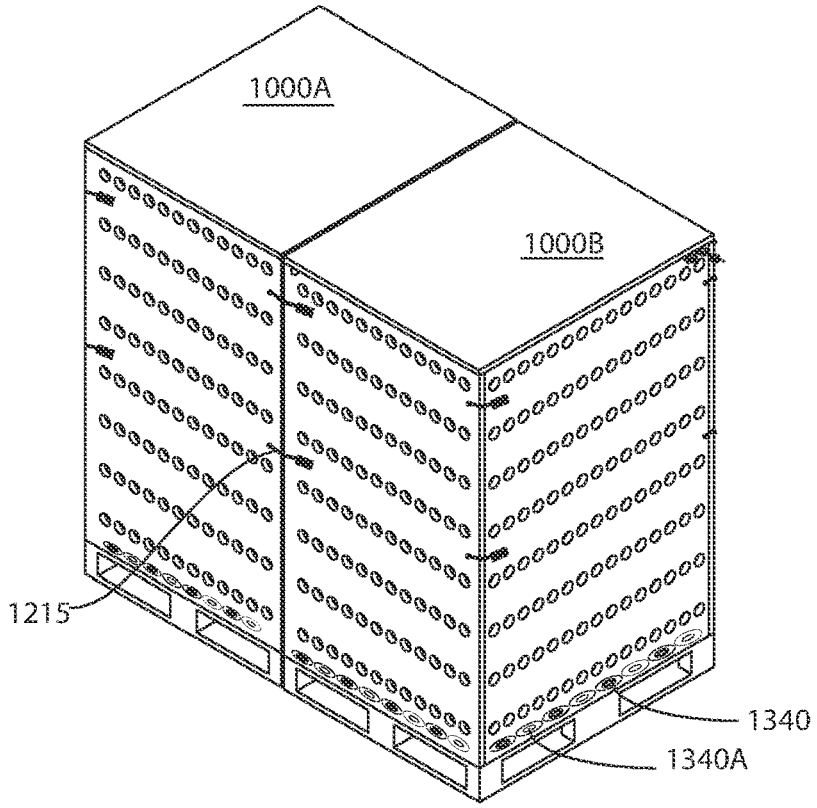
FIG. 14A provides a perspective front view of the two assembled pallet panel systems of FIG. 13 that have been joined together, according to an embodiment of the present invention.
Figure 14B:
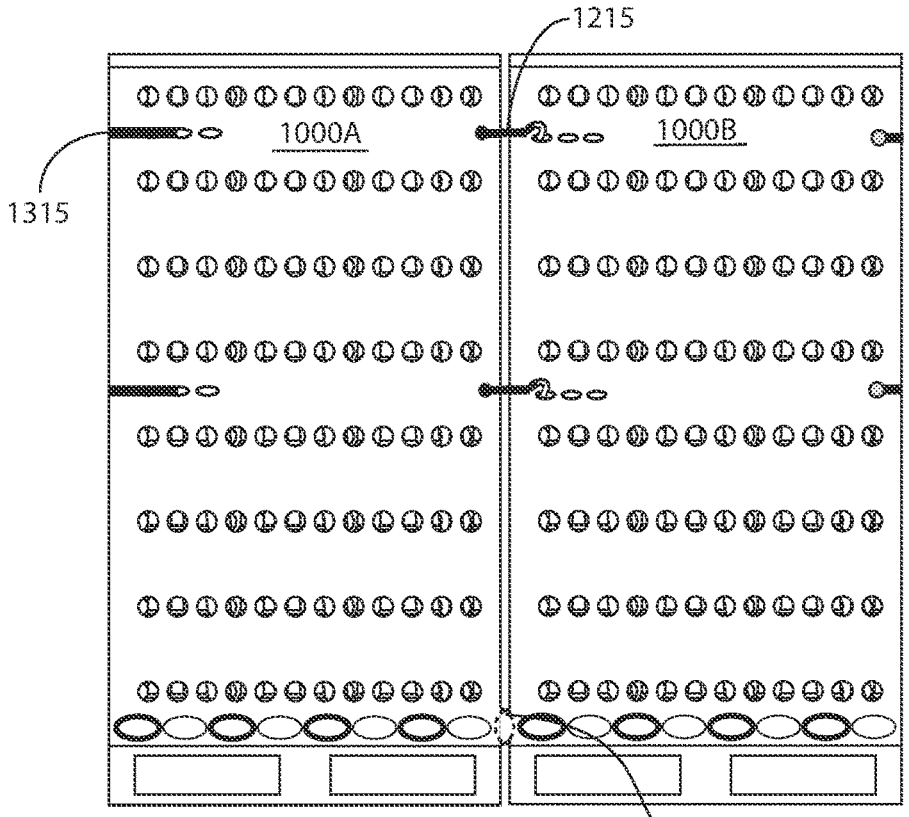
FIG. 14B provides a front view of the two assembled and joined pallet panel systems of FIG. 14A, according to an embodiment of the present invention.

Two side panels 1300 may be placed on opposite sides of the stack of bottles 1600, and the side panels are secured to the pallet base. Then front and rear panels 1200 may be aligned with pallet base 1100 and may sandwich the two side panels 1300 in place. To secure the perimeter of the container, the strap and hooks 1215, 1315 are fastened to an adjacent panel's receiver hole 1320, 1220, and the lid 1700 is placed on top of the panel perimeter, forming a container. In some embodiments, the frame 1500 may be of the clamshell type, where the frame may be formed to provide a surface with a plurality of concavities having a substantially complementary geometry to the top lip of a glass bottle. In another embodiment, the stack of glass bottles 1600 may be wrapped with a thin plastic wrapping to provide a uniform structure for the bottles. FIG. 12 provides an exemplary exploded view of the pallet container 1000.

The container pallet panel system 1000 may interlink with additional containers 1000 and may combine to ship as a single array. A view of a first container 1000A and second container 1000B is provided in FIG. 13. On the exterior surface of all the panels, there may be an alignment mechanism operable to snuggly configure adjacent pallet panel containers 1000 to align with each other for mass transportation and interlocking with each other. The alignment mechanism provides a system for aligning the containers 1000 and eliminating the need for a dampening mechanism (e.g., airbags, foam) between containers. When two or more containers 1000 are positioned adjacent to each other and locked together (FIGS. 14A-B), a string or array of container units may be formed which may operate as a single solid load, preventing the palletized stacks of bottles from toppling. In some of these embodiments, the surface side panel, 1300 of the first container 1000A, may provide male protrusions 1340 that may nest into the female cavities 1340A of the second container 1000B. Similarly, front panel channels 1240 may nest into corresponding channels 1240A when aligned with an adjacent container 1000. (It is to be appreciated that in alternative embodiments, some or all of these male/female members may be swapped.)

In some embodiments, once the containers 1000A, 1000B are interlinked, the straps of a parallel panel may be strapped to the adjacent panel's receiver hole. For example, 1215 of the front panel of the first container 1000A may hook into the receiver 1220 of the second container 1000B front panel, as shown in FIG. 14. The advantage of interlinking the containers together prevents the stack of bottles from toppling over, saves space, and eliminates additional airbags for dampening.

In some embodiments, the alignment mechanism may include alternating male protrusions 1240 and female cavities 1240A that have complementary geometries. For example, the male protrusion 1240 may extrude from the exterior surface of the front panel 1200 and have a centroid equidistant from the pallet surface 1200P and the side surface 1200A, and the female cavity 1240A may have a centroid with an equidistance from the side surface 1200B and the pallet surface 1200P. In some embodiments the outer male protrusion 1240 and female cavity 1240A may alternate; in other embodiments, they may be all male on one side and all female on the other side. It is to be appreciated that other arrangements of male and female connectors may also be used. The front and rear panel 1200 channels may be A-symmetrical related when the container is assembled, and the front surface channel 1240 may nest into the rear channel 1240A when aligned with an adjacent container 1000. Alike the front and rear surface 1200, the side panels 1300 may have an outer male protrusion 1340 and outer female cavity 1340A, and therebetween may have a series of alternating female cavities 1340A and male protrusion 1340. The male protrusions 1240, 1340 may have a surface geometry such as a triangular wedge shape, drafted protrusion, or a substantially convex outer protrusion that are operable to nest into the female cavities 1240A, 13040A which have a geometry that is complementary to the male and removed from the surface of the panels. In some embodiments, the protrusion and cavity 1240/1240A, and 1340/1340A may have a sinusoidal surface that is fixed to the outer panel's exterior surface. The male protrusion 1240/1340 may be removably attached to the outer surface with a fastener (e.g., rivet, screw, welded, etc.), and the female channel may be a material that is removed from the outer surface or may be attached to the outer surface with a fastener.

Although the embodiments described and illustrated depict certain engagement devices as male protrusions which engage with corresponding female receptacles, it is to be appreciated that any or all of these devices may be exchanged, swapping the male engagement devices for female ones, and vice versa. For example, and without limitation, female connecting channels 1230 and male connectors 1730 may be swapped, such that channels 1230 are male and connectors 1730 are female. It is also to be appreciated that although the male and female connecting members are shown as oval holes and protrusions in the illustrations herein, in other embodiments, some or all of these complementary members may be of any suitable cooperating shape including round, square, rectangular, hexagonal, octagonal or any other multi-sided shape The present invention provides a pallet panel system operable to enclose a palletized stack of glass bottles and is able to provide a boundary to protect the bottles from toppling, and eliminates plastic wrapping for stabilizing the stack of glass bottles. It is to be understood that variations, modifications, and permutations of embodiments of the present invention, and uses thereof, may be made without departing from the scope of the invention. It is also to be understood that the present invention is not limited by the specific embodiments, descriptions, illustrations, or combinations of either components or steps disclosed herein. The embodiments were chosen and described in order to best explain the principles of the invention and its practical application, thereby enabling others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. An apparatus for use in transporting a stack of fragile containers comprising:

a. a rectangular pallet base having a flat top surface with a plurality of openings along a perimeter of said surface;

b. a pair of first panels, each such first panel having top, bottom, right, and left edges, an interior surface and an exterior surface, the interior and exterior surfaces being along a first plane, wherein at least one male connecting member is provided on said bottom edge for engagement with one of said plurality of openings in said pallet base, wherein at least one hook is provided at an edge of said exterior surface, and wherein at least one rod is provided at an upper corner of said interior surface, each rod extending outward in a direction that is perpendicular to said first plane;

c. a second pair of panels, each such second panel having top, bottom, right, and left edges, an interior surface and an exterior surface, the interior and exterior surfaces being along a second plane, wherein at least one male connecting member is provided on said bottom edge for engagement with one of said plurality of openings in said pallet base, wherein at least one opening is provided at an edge of said exterior surface for receiving said at least one hook, and wherein at least one slot is provided at an end of said right and left edges for receiving said at least one rod; and d. a lid for engagement over said panels when assembled together, wherein the rods and slots comprise metals that magnetically attract.

2. The apparatus of claim 1 wherein vibration dampening elements are provided on the interior surfaces of each of said first and second panels.

3. The apparatus of claim 2 wherein said vibration dampening elements are selected from the group of foam, deformable plastic, inflatable air bags, and combinations thereof.

4. The apparatus of claim 1 wherein each of said at least one hook is mounted to a stretchable strap to provide tension to said hook when engaged with one of said at least one receiving openings.

5. The apparatus of claim 1 further comprising at least one first alignment member provided at right and left edges of said first pair of panels, and at least one second corresponding alignment member provided at right and left edges of said second pair of panels.

6. The apparatus of claim 1 wherein said lid further comprises an upper surface, a lower surface, and a plurality of openings along a perimeter of said lower surface, and wherein each of said panels includes at least one male connecting member at a top edge thereof for engagement one of said plurality of openings on said lower surface of said lid.

7. The apparatus of claim 1 wherein a plurality of rows of openings are provided in said pallet base for receiving a plurality of panels for return after use.

8. The apparatus of claim 1 wherein each panel is provided with at least one locking member on its exterior surface for engagement with a corresponding locking member on a panel of an adjacent assembled apparatus.

9. The apparatus of claim 1 wherein said pallet base is provided with at least one locking member at an edge thereof for engagement with a corresponding locking member at an edge of a pallet base of an adjacent assembled apparatus.

10. The apparatus of claim 1 further comprising a frame having a plurality of openings therein corresponding to tops of containers of a stack for engagement over an uppermost stack of such containers below said lid.

11. The apparatus of claim 1 wherein at least one of said first or second pair of panels includes at least one viewing window thereon.

12. A pallet panel container system for use in transporting a stack of fragile containers comprising:

a. a rectangular pallet base having a flat top surface with a plurality of openings along a perimeter of said surface;

b. a plurality of panels, each panel having top, bottom, right, and left edges, an interior surface and an exterior surface, and a vibration dampening element on said interior surface, wherein at least one male connecting member is provided on said bottom edge for engagement with one of said plurality of openings in said pallet base, wherein at least one hook is provided at one of the right or left edges of said exterior surface, and at least one receiving opening is provided at the other of said right or left edges of said exterior surface, such that the at least one hook of a first panel may engage with the at least one receiving opening of an adjacent panel; and c. a lid for engagement over said panels when four of said panels are assembled together, wherein a plurality of first attractive elements are provided on one of said right edges or said left edges, and a plurality of second attractive elements are provided on the other of said right edges or said left edges, wherein said first and second attractive elements comprise metals that magnetically attract.

13. The system of claim 12 wherein said lid further comprises an upper surface, a lower surface, and a plurality of openings along a perimeter of said lower surface, and wherein each of said panels includes at least one male connecting member at a top edge thereof for engagement one of said plurality of openings on said lower surface of said lid.

14. The system of claim 12 wherein said vibration dampening elements are selected from the group of foam, deformable plastic, inflatable air bags, and combinations thereof.

15. The system of claim 12 wherein each of said at least one hooks is mounted to a stretchable strap to provide tension to said hook when engaged with one of said at least one receiving openings.

16. The system of claim 12 wherein each panel is provided with at least one locking member on its exterior surface for engagement with a corresponding locking member on a panel of an adjacent assembled container system.

17. The system of claim 12 wherein said pallet base is provided with at least one locking member on an exterior edge thereof for engagement with a corresponding locking member at an edge of a pallet base of an adjacent assembled container system.

18. A method of securing stacks of bottles for transport comprising the steps of:

a. loading stacks of bottles onto a rectangular pallet base, the pallet base comprising a flat top surface with a plurality of openings along a perimeter of said surface, wherein the stacks are separated by slip sheets;

b. engaging male connecting members located on bottom edges of left and right side panels with openings on opposite sides of the pallet base, each such side panel further comprising a top, right, and left edges, an interior surface and an exterior surface, the interior and exterior surfaces being along a first plane, wherein at least one receiving opening is provided at an edge of said exterior surface, and wherein a pair of metallic slots are provided at ends of said right and left edges;

c. tilting each of said side panels up to a generally vertical position;

d. engaging male connecting members located on bottom edges of front and rear panels with openings on opposite sides of the pallet base between said side panels, each such front and rear panel further comprising top, right, and left edges, an interior surface and an exterior surface, the interior and exterior surfaces being along a second plane, wherein at least one hook is provided at an edge of said exterior surface, and wherein a pair of magnetic rods are provided at upper corners of said interior surface, each rod extending outward in a direction that is perpendicular to said second plane;

e. tilting each of said front and rear panels up to a generally vertical position and inserting said rods into said slots for temporary magnetic engagement;

f. engaging each of said hooks of said front and rear panels with one of said receiving openings on a side panel to form a four-sided enclosure around said stacks of bottles; and g. placing a lid on the four-sided enclosure to form a completed container.

19. The method of claim 18 comprising the additional step of temporarily engaging a locking connector located on one of said panels of said completed container with a corresponding locking connector located on a corresponding panel of another completed container.

20. An apparatus for use in transporting a stack of fragile containers comprising:

a. a rectangular pallet base having a flat top surface with a plurality of openings along a perimeter of said surface;

b. a pair of first panels, each such first panel having top, bottom, right, and left edges, an interior surface and an exterior surface, the interior and exterior surfaces being along a first plane, wherein at least one male connecting member is provided on said bottom edge for engagement with one of said plurality of openings in said pallet base, wherein at least one hook is provided at an edge of said exterior surface, and wherein at least one rod is provided at an upper corner of said interior surface, each rod extending outward in a direction that is perpendicular to said first plane;

c. a second pair of panels, each such second panel having top, bottom, right, and left edges, an interior surface and an exterior surface, the interior and exterior surfaces being along a second plane, wherein at least one male connecting member is provided on said bottom edge for engagement with one of said plurality of openings in said pallet base, wherein at least one opening is provided at an edge of said exterior surface for receiving said at least one hook, and wherein at least one slot is provided at an end of said right and left edges for receiving said at least one rod; and d. a lid for engagement over said panels when assembled together, wherein a first attractive element is provided adjacent to one of said rods or slots, and a second attractive element is provided adjacent to a complementary other of said rods or slots, wherein said first and second attractive elements comprise metals that magnetically attract.

21. The apparatus of claim 20 wherein vibration dampening elements are provided on the interior surfaces of each of said first and second panels.

22. The apparatus of claim 20 wherein each of said at least one hook is mounted to a stretchable strap to provide tension to said hook when engaged with one of said at least one receiving openings.

23. The apparatus of claim 20, wherein the top edges of each of said pair of first panels and each of said second pair of panels further comprise a plurality of first attractive elements, and wherein said lid further comprises a bottom surface having a second plurality of attractive elements wherein said first and second attractive elements comprise metals that magnetically attract.

24. The apparatus of claim 1, wherein the top edges of each of said pair of first panels and each of said second pair of panels further comprise a plurality of first attractive elements, and wherein said lid further comprises a bottom surface having a second plurality of attractive elements wherein said first and second attractive elements comprise metals that magnetically attract.

25. The system of claim 12, wherein the top surface of each of said plurality panels further comprises a plurality of first attractive elements, and wherein said lid further comprise a bottom surface having a second plurality of attractive elements wherein said first and second attractive elements comprise metals that magnetically attract.

* * * * *